United States Patent [19]

Karas, Jr.

[11] Patent Number: 4,486,021

[45] Date of Patent: Dec. 4, 1984

[54] METHOD OF PLAYING A NAVAL MANEUVERING GAME

[76] Inventor: Jim S. Karas, Jr., 4454 N. Arthur St., Fresno, Calif. 93705

[21] Appl. No.: 437,941

[22] Filed: Dec. 27, 1982

[51] Int. Cl.[3] ..... A63F 3/00

[52] U.S. Cl. ..... 273/255

[58] Field of Search ..... 273/260, 261, 262, 242, 273/243, 255, 265

[56] References Cited

U.S. PATENT DOCUMENTS

| | | | |
|---|---|---|---|
| 1,294,256 | 2/1919 | George | 273/262 |
| 3,794,326 | 2/1974 | Bialek | 273/260 |
| 3,806,125 | 4/1974 | Bialek | 273/260 |

*Primary Examiner*—Richard C. Pinkham
*Assistant Examiner*—Matthew L. Schneider
*Attorney, Agent, or Firm*—Victor Sepulveda

[57] ABSTRACT

A game which uses two (2) sets of player pieces, one set for each player. The game is played with two (2) players, each opposing the other. The playing pieces are arranged on a playing surface, or game board, which is comprised of evenly spaced checkered squares thereon. Each player has the same number of playing pieces evenly distributed on a portion of half the board and facing the player tokens of the opposite party. The object of the game is to capture the player tokens of the other party by either eliminating and taking the player token of the other party or completely surrounding and immobilizing it. A player can capture an opponent's token by placing two of his tokens on the same square that one of his opponent's tokens is located. A player can immobilize an opponent's token by placing two tokens on all squares adjacent to the square on which the opponent's token is located. The games includes dice for indicating the advancement of player tokens in a selected direction.

8 Claims, 4 Drawing Figures

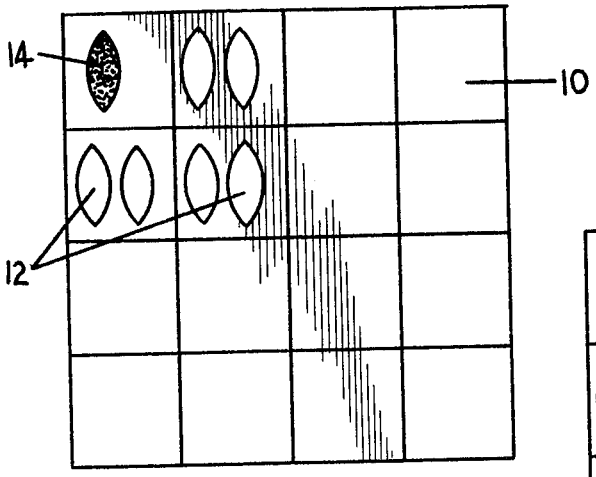
FIG. 4a
FIG. 4b
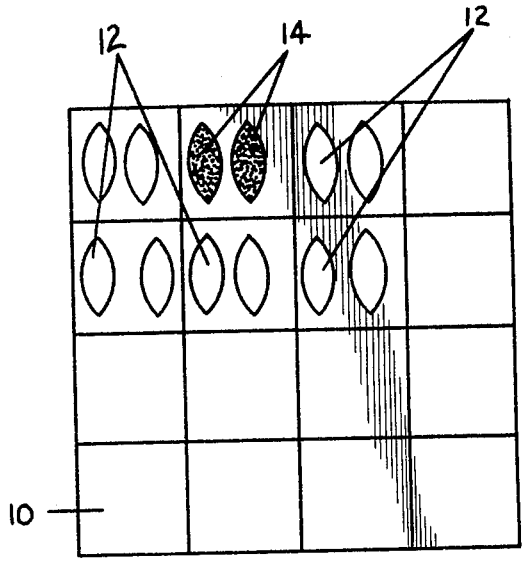
FIG. 4c
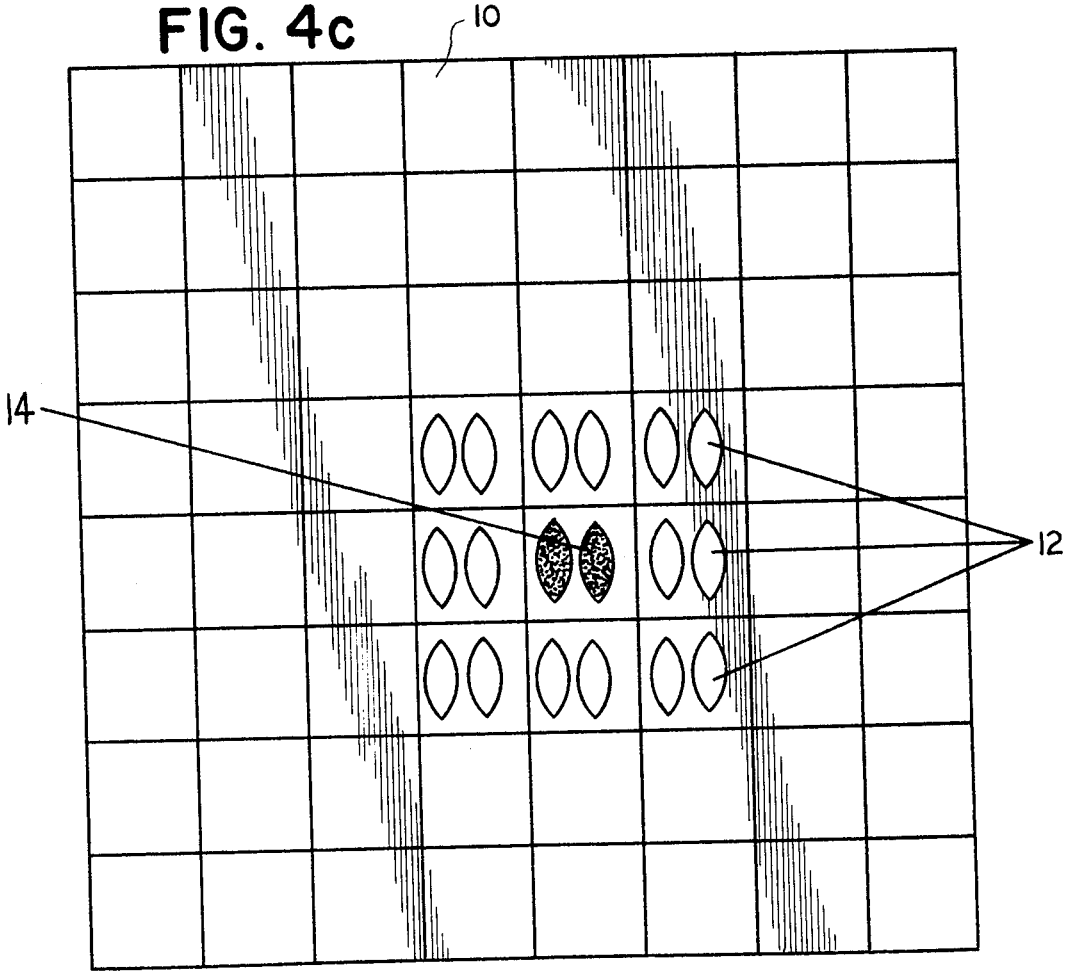

METHOD OF PLAYING A NAVAL MANEUVERING GAME

BACKGROUND

This invention relates to games, and more particularly to a game involving two players having a plurality of playing tokens on a checker board and a pair of dice to indicate movement of the player pieces.

Many games have been devised in the past wherein a combination of skill and chance are involved with some games having more of a tendency to be based upon skill, while other games have a tendency to be based upon chance. The most desirable type of game would be one in which the player's skill dominates over chance, such as the present invention.

The skill involved in the present invention is one which takes into consideration the strategy of the player in which he maneuvers his playing pieces based upon the chance roll of the dice. If a player becomes very, very skillful, a roll of the dice plays very little part in his chances of winning the game over his opponent as does the chance.

There are many games in which movements of player pieces are based upon the roll of the dice, yet the skill of the player still dominates over chance. One such game is backgammon. Games in which the players are moved in directions directly opposite (against) the other and capture opponent's playing pieces include checkers and chess. However, in these latter games, chance indicators such as dice are not used to regulate or limit the movement of the player pieces. A preferred game is one in which the limiting factor of the number of moves is used to regulate the advancement of player pieces, yet the skill of how to best use the limitation of movement in maneuvering the player pieces to overcome and capture or immobilize the opponent's player pieces.

An aspect of the present invention would involve the use of player tokens having a resemblance of ships and the player board being the open sea. The movement of the player pieces resembling ships would be maneuvered by the roll of the dice of each party, indicating in which direction movement of the player pieces would take. If one party could get two (2) of his player tokens on the same square as an opponent, he then is able to capture the opponent's player piece and take it off the board, or he may be able to surround the player token of the other party and immobilize it. The first person who completely captures or immobilizes all of the playing pieces of the other party is declared the winner.

DESCRIPTION OF THE DRAWINGS

These and other features and advantages will become more apparent to those skilled in the art when taking into consideration the following detailed description wherein like referenced numerals indicate like and corresponding parts throughout several views and wherein:

FIG. 4 is a diagram of the present invention showing how trapping is effected.

DESCRIPTION OF THE SHOWN EMBODIMENT

Herein described is a game which I devised for the purpose of maneuvering ships about the open seas in an effort to out-maneuver an opponent so that the capture, or surrounding, of all the opponent's player tokens takes place before your opponent can capture or surround your player tokens.

Figure 1:
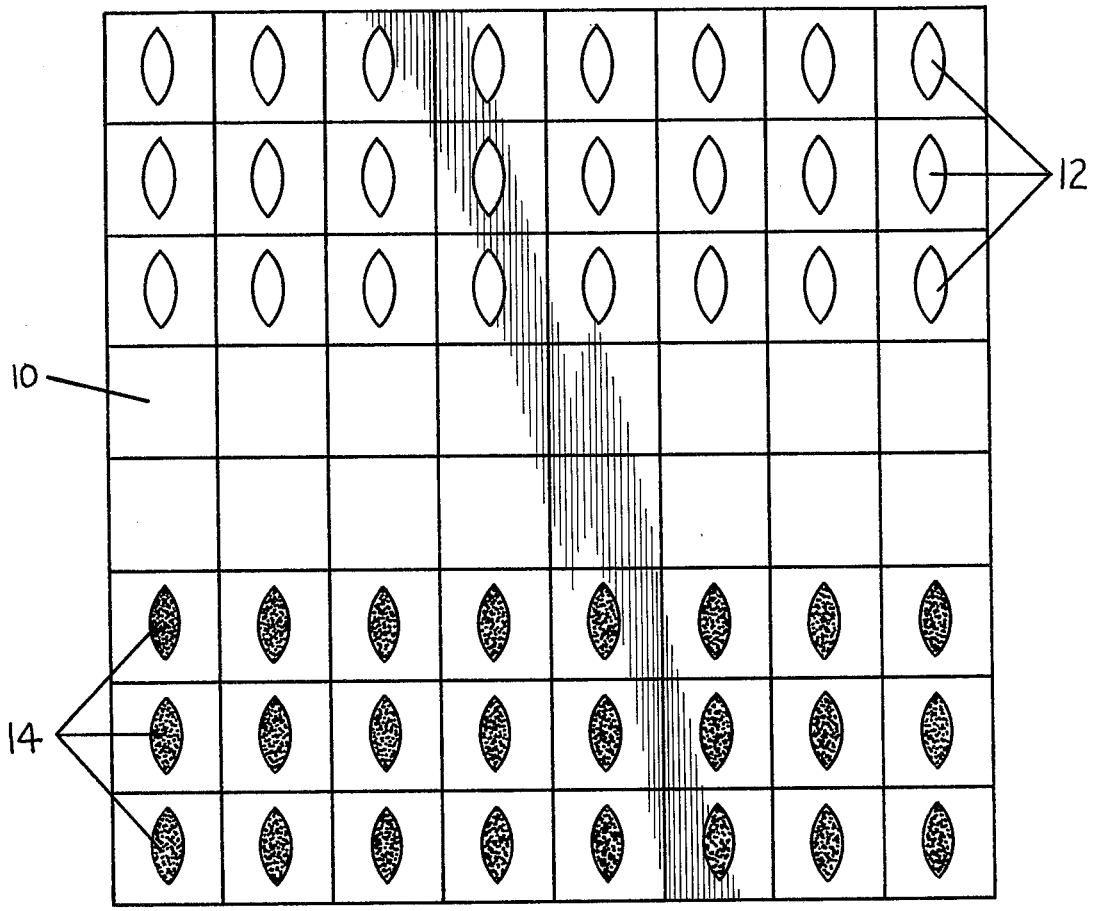
FIG. 1 is a top plan view of the checker board used with this invention, showing the position of all player pieces (ships) at the start of each game.
Figure 2:
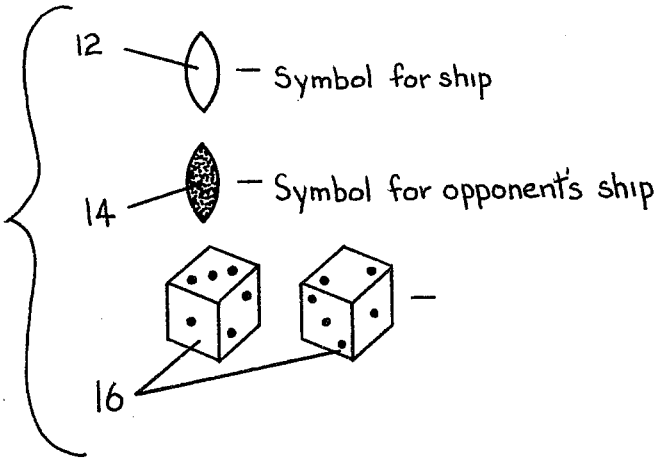
FIG. 2 shows a reference to the symbols for the ships (playing pieces) used in FIG. 1.

Turning now to a more detailed description of but one preferred embodiment of this invention, wherein is shown in FIG. 1 a game board 10 with the initial set-up of the player pieces 12 and opponent's pieces 14 on a checker board which are lined up much the way one would line up the game of chess, that is three (3) rows of ships 12 facing the opponent's three (3) rows of ships 14. The symbol for the ship is shown in two (2) different indicias, whereby a solid line would illustrate ships 12 of one color facing the ships 14 facing the other party, shown in a broken line.

In the shown embodiment, there are forty-eight (48) ships which might be, for example, twenty-four (24) green ships (shown in solid line) and twenty-four (24) yellow ships (shown in hidden line). The maneuvering board 10 may, in the shown embodiment, be 18 inches by 18 inches and the party would need two (2) pair of dice 16 to play a game, one pair for each player.

To begin the game, the ships 12 are set up in the first three (3) rows of the squares as shown in FIG. 1 nearest the player, for a total of twenty-four (24) ships. The opponent will also have twenty-four (24) ships 14 in the first three (3) rows facing player's ships 12. One would then need to choose which party would play first. This could be handled by each party rolling one die, for example, so that the party with the highest number on the die (or dice if preferred) would begin first. Thereafter, each player would roll in turn and move his ships accordingly. When the first player rolls two (2) dice, he then moves one (1) ship the number of squares an equal number of spaces as shown on the dice. Each player could, for example, move two (2) ships. For example, if he rolled a four (4) and a one (1), he could move one ship four (4) spaces and another ship one (1) space, or the player may move the same ship four (4) spaces and the one (1) space. A player may move a ship forwards, backwards, sideways, or diagonally into a square where there is one (1) ship, or no ships. He may not land on or pass through a square occupied by any two (2) ships.

A move is completed by a player when a ship is released by hand. Once played, a ship cannot be moved until the player's next turn.

Figure 3A:
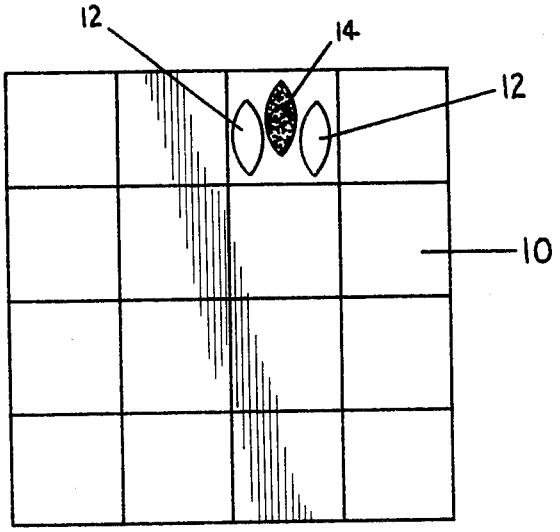
FIG. 3 shows a diagram of portions of the game board whereby captures are effected.
Figure 3B:
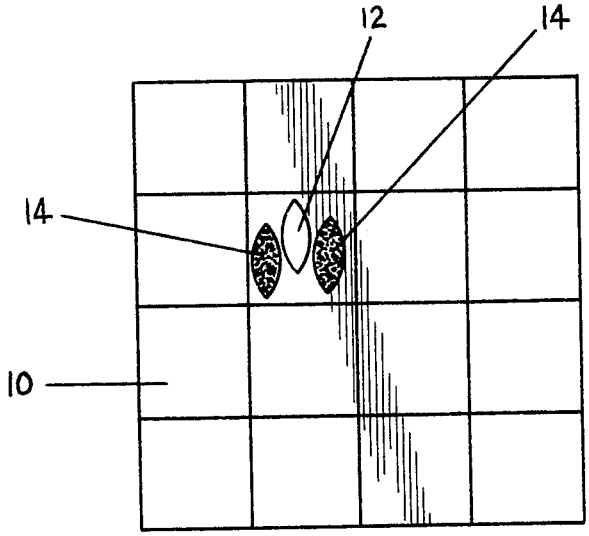
Figure 3C:
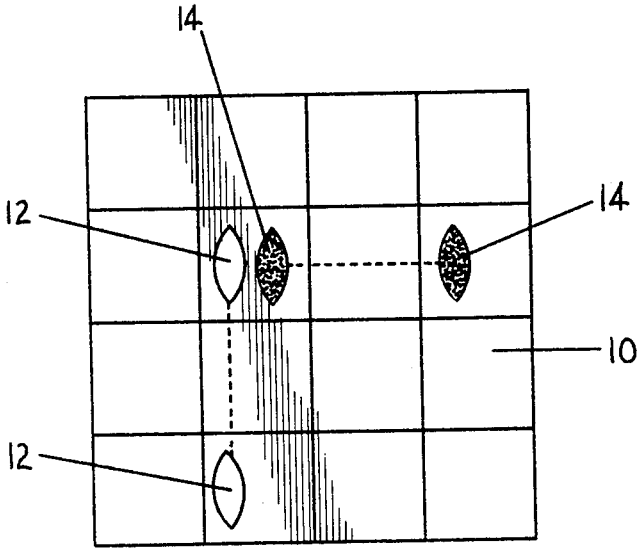

Referring to FIGS. 3 and 4, there are shown different positions in which a ship may move within its squares, based upon the roll of the dice. 3*a* illustrates the game board 10 which has thereon two (2) of the player's ships 12 and one of the opponent's ships 14. If two (2) of player's ships 12 are caused to land on the same square where the opponent's ship 14 is, then that ship is captured. FIG. 3*b* shows two (2) of the opponent's ships 14 in the same square as player's ship 12, which shows that player's ship 12 is now captured.

The object of the game is to win by capturing all of opponent's ships 14, or by trapping your opponent's ships 14 by surrounding with two (2) of your ships in each adjacent square. One may also win by a combination of capturing or trapping opponent's ships 14, completely immobilizing your opponent's fleet. The only manner in which a capture may be performed without taking the ship is to have two (2) ships 12 of your color in all adjacent squares on either side of your opponent's ship 14 or the ends of the game board may be used on one or two sides to assist in the capture. This capture is easy to recognize because the captured ship cannot pass through any square occupied by two (2) of the opponent's ships 14.

As a further playing sequence, a ship 12 may not pass through any square occupied by any two (2) player ships or opponent ships 14. Once a ship 12 is captured, it must be removed from the board. A player may capture one (1) or two (2) ships at a time.

A further playing sequence which may be used, if so desired, is that if a player rolls doubles on the dice, the player gets a second roll and a third roll; however, the player shall only have three (3) rolls.

Thus, there has been shown and described a new and novel game which can be played on a playing board by two (2) players which includes a game of skill, as in maneuvering ships at sea.

I claim:

1. A method of playing a game simulating manuevering ships in combat at sea for two (2) players comprising the steps of:

A. providing a first and second set of playing pieces including means for distinguishing the first set of playing pieces from the second set;

B. providing a playing surface comprising a checker board grid having a predetermined number of squares, having a first playing side and a second playing side;

C. spacing the first set of playing pieces on said playing surface distributed in the squares on the first playing side;

D. spacing the second set of playing pieces on said playing surface distributed in the squares on the second playing side;

E. providing chance means, to be manipulated by each player;

F. selecting one of said 2 players to commence play, each player playing in sequence thereafter;

G. manipulating said chance means by said selected player such that certain indicia is displayed on the upper face of said chance means, the displayed indicia being related to the amount of movement permitted by the playing pieces;

H. moving said playing pieces a number of squares corresponding to said displayed indicia;

I. said selected player moving his playing pieces so as to place at least two (2) of his playing pieces in the same square occupied by one (1) of the playing pieces of the other player; such that the occupation of a square by said selected player's at least two pieces results in the capture of said other player's one piece;

J. repeating said sequence of play of said players until one player, repeating the sequence of play, captures all the playing pieces of the other player.

2. The method as defined in claim 1 wherein said chance means are dice.

3. The method as defined in claim 1 wherein said playing surface is a game board having a number of equally spaced checkered squares thereon.

4. The method as defined in claim 1 wherein said means for distinguishing said playing pieces from each other includes pieces of different colors.

5. The method as defined in claim 1 wherein said playing pieces resemble naval ships.

6. The method as defined in claim 1 and including a further step of manueuvering said playing pieces of the selected player in step F to place two (2) of the selected player's pieces on two (2) sides of the other play's pieces to surround and capture said other play's pieces.

7. The method as defined in claim 6 and wherein: said chance means are dice;

said playing surface is a game board having a number of equally spaced checker squares thereon; and said first set of playing pieces is a different color from said second set of playing piece.

8. The method as defined in claim 7 wherein said playing pieces resemble naval ships.

* * * * *